US005275906A

United States Patent [19]

Materazzi

[11] Patent Number: 5,275,906

[45] Date of Patent: Jan. 4, 1994

[54] METHOD OF FORMING A PATTERN USING A LIQUID COLOR TONER COMPOSITION

[75] Inventor: Peter E. Materazzi, Southington, Conn.

[73] Assignee: Olin Corporation, Cheshire, Conn.

[21] Appl. No.: 874,468

[22] Filed: Apr. 27, 1992

Related U.S. Application Data

[60] Division of Ser. No. 657,012, Feb. 15, 1991, Pat. No. 5,116,705, which is a continuation-in-part of Ser. No. 498,785, Mar. 26, 1990, abandoned.

[51] Int. Cl.[5] ..... G03G 13/14

[52] U.S. Cl. ..... 430/126; 430/115; 430/313; 430/318

[58] Field of Search ..... 430/126, 313, 318, 115

[56] References Cited

U.S. PATENT DOCUMENTS

| | | | |
|---|---|---|---|
| 3,669,886 | 6/1972 | Kosel | 252/62.1 |
| 3,900,412 | 8/1975 | Kosel | 252/62.1 |
| 3,990,980 | 11/1976 | Kosel | 252/62.1 |
| 3,993,483 | 11/1976 | Maki et al. | 96/1 LY |
| 4,181,620 | 1/1980 | Tsubuko | 430/114 |
| 4,575,478 | 3/1986 | Ohno . | |
| 4,661,431 | 4/1987 | Bujese | 430/126 |
| 4,732,831 | 3/1988 | Riesenfeld et al. | 430/60 |
| 4,786,572 | 11/1988 | Haku et al. | 430/60 |
| 4,786,576 | 11/1988 | Bujese et al. | 430/126 |
| 4,789,616 | 12/1988 | Croucher et al. | 430/109 |
| 4,798,778 | 1/1989 | El-Sayed et al. | 430/115 |
| 4,855,207 | 8/1989 | Tsubuko et al. | 430/115 |
| 4,925,766 | 5/1990 | Elmasry et al. | 430/115 |
| 4,946,753 | 8/1990 | Elmasry et al. | 430/45 |
| 4,971,883 | 11/1990 | Chan et al. | 430/114 |
| 4,978,598 | 12/1990 | Elmasry et al. | 430/115 |
| 4,988,602 | 1/1991 | Jongewaard et al. | 430/115 |

FOREIGN PATENT DOCUMENTS

| | | |
|---|---|---|
| 0243934 | 11/1987 | European Pat. Off. . |
| 0252735 | 1/1988 | European Pat. Off. . |
| 2313547 | 3/1973 | Fed. Rep. of Germany . |
| 50-32624 | 10/1975 | Japan . |
| 6076755 | 10/1983 | Japan . |
| 5428629 | 12/1987 | Japan . |
| 1563240 | 3/1980 | United Kingdom . |

*Primary Examiner*—Marion E. McCamish
*Assistant Examiner*—S. Rosasco
*Attorney, Agent, or Firm*—William A. Simons

[57] ABSTRACT

Described herein is a liquid color composition containing a resin binder and a plasticizer which is compatible with the binder. The toner is very transparent and produces excellent quality images when used in xeroprinting processes.

3 Claims, No Drawings

METHOD OF FORMING A PATTERN USING A LIQUID COLOR TONER COMPOSITION

This application is a division of Application Ser. No. 07/657,012, filed Feb. 15, 1991 which issued as U.S. Pat. No. 5,116,705 on May 26, 1992 and which was a continuation-in-part application of Ser. No. 07/498,785 filed Mar. 26, 1990, now abandoned.

2. FIELD OF THE INVENTION

This invention is directed to a liquid color toner composition containing a particular resin matrix binder and a plasticizer which is compatible with the binder. The toner is very transparent and produces excellent quality images particularly when used in transfer xeroprinting processes.

2. BACKGROUND OF THE INVENTION

Liquid toner compositions for use in developing latent electrostatic images are well-known in the art. However, in order for a toner to be suitable for use, particularly in a gap transfer xeroprinting process, it requires the following properties:

(a) the ability to use standard pigments in the toner formulation;

(b) the toners used for multicolor printing must be transparent. This is achieved by making a fine homogeneous dispersion of the pigment within a dispersed phase binder. All of the toner components must be compatible in order that they can be fused into a clear, transparent film;

(c) the toner needs a relatively large Particle size in order to reduce surface area and Van der Waals forces in order to achieve high transfer efficiency;

(d) the toner must be easily dispersed after it settles, so as to eliminate any gelling problems in the machine in which it is used;

(e) the toner must image with excellent resolution, good solid densities, and no background on the electrostatically imageable surface, and it must maintain these properties during the transfer steps;

(f) the toner must have good adhesion to paper when fused; and (g) the toner system should behave relatively independently of the pigments used so that different color toners can be mixed together to produce a desired shade.

Known toner materials have only fulfilled the above-discussed requirements to a limited extent. Useful liquid toners comprise a resin and nonpolar liquid. Generally, a suitable colorant is present, such as a dye or pigment. The color toner particles are dispersed in the nonpolar liquid which generally has a high volume resistivity, a low dielectric constant, and a high vapor Pressure. These toners are generally prepared by forming a dispersion of a resin, nonpolar liquid, and colorant and then milling the dispersion with more nonpolar liquids and other desired additives. This Preparation is easy but is very difficult to design properly. The performance of the toner is very pigment dependent, and each color would need to be formulated separately. It is difficult to make a transparent toner using such methods.

A method of formulating a nonhazy or transparent toner is described in U.S. Pat. No. 4,507,377. The toner is made from a compatible blend of a polyester resin and a polyester plasticizer characterized in that it is substantially insoluble in the carrier liquid. The toner in the patent is self-fixing and not used in a transfer system.

A disadvantage of the toner system of said patent is that we have found that it is difficult to disperse pigments into polyester systems. Also, the polyesters tend to swell in a carrier liquid, such as in Isopar. Thus, the toner system of U.S. Pat. No. 4,507,377 does not meet the requirements, discussed above, for an acceptable toner system for transfer xeroprinting processes.

Another disadvantage of color liquid toners is that the toners do not claim to be usefully blendable to form distinct process colors. Because of the difference in electrophoretic mobility of each differently pigmented toner, a blend of two or more toners will selectively deplete as multiple images are made and the hue would continually change.

The toner of this invention behaves independently of the pigment used; in that each toner has identical electrophoretic mobility. They can be blended in the same manner as inks for spot color such as in the Pantone TM Color Matching System. Individual toners can be easily made using blends of pigment to give a special distinct hue.

DESCRIPTION OF THE INVENTION

In the present invention, a composition of a liquid color toner has been found which meets the properties, as discussed above, enabling it to be used effectively in a gap transfer xeroprinting process, and also in a contact transfer xeroprinting process. The toner is very transparent and produces excellent quality images when used in transfer xeroprinting processes. Additionally, the toner of this invention behaves independently of the pigment used, due to the high compatibility of the pigment and the resin. The pigment is essentially encapsulated in the toner particles as shown in Examples 13 to 48, presented herein.

Also, the nonswellable nature of the resin in the toner of this invention allows a very high toner content in the organic solvent as shown in Example 49, presented herein, while maintaining a low viscosity. Further, it has been found that these particles can be directly diluted from as high as a 40% solids concentration into less than a 1% solids premix with no flocculation or agglomeration of the particles. This allows for a very high solids replenishment system Specifically, the liquid color toner composition of this invention comprises:

(a) an organic solvent, (b) a fine particle size compounded mixture comprising:

(i) a resin matrix which is essentially insoluble and nonswellable in said solvent, (ii) submicron-sized pigment particles dispersed within the resin, and (iii) a plasticizer which is compatible with the resin, said compounded mixture being essentially insoluble and nonswellable in said solvent; and (c) a dispersing agent capable of dispersing the particles in the compounded mixture.

The resin matrix suitable for use in the toner composition of this invention is characterized by the following Properties: it is capable of binding the pigment; it has limited solubility in the organic carrier solvent; it is hard and friable at room temperature; it has good pigment wetting properties; and it has a relatively low melting point (less than about 110° C.). The resin is further characterized as having an acid number Preferably greater than about 50. The resins suitable for use herein include maleic modified rosin, maleic modified pentaerythritol rosin, wood rosin, acid modified phenolics, and the like. The preferred resin is maleic modified rosin. The resin matrix constitutes from about 50 to about 99%, preferably from about 85 to about 95% by weight solids of the toner composition.

Most common organic pigments may be used in the composition of this invention. The Pigments are used in amounts of from about 1 to about 50%, preferably from about 5 to about 15% by weight solids in the toner. Pigments suitable for use herein include copper phthalocyanine blue (C.I. Pigment Blue 15), Victoria Blue (C.I. Pigment Blue 1 and 2), Alkali Blue (C.I. Pigment Blue 61), diarylide Yellow (C.I. Pigment Yellow 12, 13, 14, and 17), Hansa yellow (C.I. Pigment Yellow 1, 2, and 3), Tolyl orange (C.I. Pigment Orange 34), Para Red (C.I. Pigment Red 1), Naphthol Red (C.I. Pigment Red 2, 5, 17, 22, and 23), Red Lake C (C.I. Pigment Red 53), Lithol Rubine (C.I. Pigment Red 57), Rhodamine Red (C.I. Pigment Red 81), Rhodamine Violets (C.I. Pigment Violet 1, 3, and 23), and copper phthalocyanine green (C.I. Pigment Green), among many others. Many of these Pigments are used in Examples 13 to 48, Presented herein. Inorganic Pigments may also be used in the toner composition of this invention. These include carbon black (C.I. Pigment Black and 7), chrome yellow (C.I. Pigment Yellow 34), iron oxide (C.I. Pigment Red 100, 101, and 102), and Prussian Blue (C.I. Pigment Blue 27), and the like. Solvent dyes may also be used, Provided they are insoluble in the carrier solvent and soluble in the binder resin. These are well-known to those skilled in the art.

The plasticizer suitable for use in the toner composition of this invention is characterized as one which is essentially insoluble in the carrier solvent and compatible with the resin matrix and pigment. These plasticizers include ethylene glycol, Polyethylene glycol, dimethyl phthalate, polypropylene glycol, low molecular weight polyamides, and the like. Polyester plasticizers that are insoluble in commonly employed isoparafinic hydrocarbon carrier liquids can also be used. They are sold under the trademarks Paraplex G-50, Paraplex G-60, and Paraplex RGA-2500 by Rohm and Haas. The preferred plasticizer is Polyethylene glycol. The Plasticizer has a molecular weight of from about 100 to about 10,000, preferably from about 1,000 to about 10,000. The plasticizer constitutes from about 0.5 to about 20%, preferably from about 5 to about 10% by weight of the toner composition.

The preferred dispersing agent useful in this invention are amphipathic graft polymers characterized as having a carrier soluble component and a grafted carrier insoluble component. The grafted insoluble component should preferentially adsorb on the surface of the toner particles. Particularly useful dispersants are those described in U S. Pat. No. 3,900,412, which is incorporated herein by reference. Many other suitable dispersants are known to those in the art. The dispersants can be used in amounts of from about 1 to 50% of toner solids weight and Preferably in the 5 to 30% range. Many of the amphipathic graft dispersants, described in U.S. Pat. No. 3,900,412, also impart a strong negative toner charge when used with the binder resins of this invention.

Additionally, other charge control agents may be used. Many are known in the art. Examples of negative charge control agents are lecithin, barium petronate, sodium dialkyl sulphosuccinate, and polybutylene succinimide. Examples of positive charge control agents are aluminum stearate, cobalt octoate, zirconium naphtenate, and chromium alkyl salicylate. Typically, charge control additives are used in amounts ranging from 0 to 5% of the toner solids weight.

The preferred organic solvents are generally mixtures of $C_9$–$C_{11}$ or $C_9$–$C_{12}$ branched aliphatic hydrocarbons sold under the trade name Isopar G and Isopar H, respectively, manufactured by the Exxon Corporation; or equivalents thereof. The electrical resistivity is preferably on the order of at least about $10^{10}$ ohm-centimeters, and the dielectric constant is preferably less than 3.

The liquid color toner composition of this invention is generally Prepared in two steps. In the first step, one or more Pigments, the resin matrix (binder) and plasticizer are compounded in an extruder, Banbury, three roll mill or other suitable equipment at a temperature of from about 70° to about 110° C. In this step, the piqment(s) are broken down to a particle size of from about 0.1 to about 1.0 microns, and dispersed together with the plasticizer homogeneously into the binder. After compounding, the resultant mixture is cooled to room temperature and pulverized in a Fitz mill or other suitable coarse grinding device. In the second step, the mixture from the first step, dispersant, organic solvent, and any optional ingredient is added to a ball mill, or other suitable equipment, and attrited to the desired toner particle size of less than 10 microns.

The liquid color toner composition is especially suitable for use in a gap transfer xeroprinting Process, such as that described in U.S. Pat. No. 4,786,576, which is incorporated herein by reference. This Patent describes a method of fabricating a toned pattern on an electrically isolated nonabsorbent conductive receiving surface, comprising the steps of:

(a) establishing a charged electrostatic latent image area on an electrostatically imageable surface;

(b) developing the electrostatic latent image area by applying to the electrostatically imageable surface charged toner particles of a predetermined height suspended in a liquid comprised at least partially of a nonpolar insulating solvent to form a first liquid layer with a first liquid surface, the charged toner particles being directed to the latent image area of the electrostatically imageable surface to form a developed latent image;

(c) applying to the conductive receiving surface a liquid comprised at least partially of a nonpolar insulating solvent to form a second liquid layer with a second liquid surface;

(d) establishing an electric field between the electrostatically imageable surface and the conductive receiving surface by connecting a D.C. voltage directly to the conductive receiving surface;

(e) placing the conductive receiving surface adjacent to the electrostatically imageable surface so that a gap is maintained therebetween, and the first liquid surface contacts the second liquid surface to create a liquid transfer medium across the liquid-filled gap, the liquid-filled gap being of a depth greater than the height of the toner particles.

(f) transferring the developed latent image from the electrostatically imageable surface at a point of transfer through the liquid to the conductive receiving surface to form a transferred toner particle image in an imaged area and defined nonimaged area where toner particles are absent;

(g) maintaining the gap during transfer of the developed latent image between the electrostatically imageable surface and the conductive receiving surface at the point of transfer between at least about 1 mil and about 20 mils; and (h) fusing the transferred toner particles image to the conductive receiving surface.

Additionally, said Process may include the following steps:

(a) etching the nonimaged areas of the conductive receiving surface to remove the conductive receiving surface from the nonimaged areas of the conductive receiving surface on the conductor laminate; and (b) removing the toner particles from the imaged area.

EXAMPLES

The following examples are presented to define the invention more fully without any intention of being limited thereby.

EXAMPLE 1

A toner was prepared in two parts as follows:

| Part 1 | Weight (grams) |
|---|---|
| (a) Colorant[1] | 200.0 |
| (b) Resin[2] | 1800.0 |
| (c) Plasticizer[3] | 200.0 |

[1]Heliogen Blue D7072 available from BASF.
[2]Unirez 709 available from Union Camp.
[3]Polyethylene Glycol 600 available from Aldrich.

These components were added into a sealable plastic container and mixed together by shaking for a few minutes. They were then removed from the plastic container and added into the feed hopper of a twin screw extruder (Werner and Pfleiderer ZSK-30). The extruder temperature was adjusted to between 70° C. and 85° C., and the screw speed was adjusted to 170 rpm. A die with two 1/16 inch holes was fitted onto the extruder. The hopper was turned on and the feed rate was adjusted to bring the extrusion torque between 2,000 and 4,000 Newton-meters. It took approximately 20 to 30 minutes to extrude the whole batch.

A small piece of the extruded material was smeared onto a hot microscope slide, cooled to room temperature, and viewed under a microscope. Very few large pigment Particles (>1 micron) remained, and the dispersion appeared very homogeneous and transparent.

The remainder of the extruded batch was cooled to room temperature and then Pulverized using a Fitz mill with an 0.0033 inch mesh screen. Part 1 now comprised a homogeneous Powder with an average particle size of about 100 microns.

| Part 2 | Weight (grams) |
|---|---|
| (a) Part 1 above | 250 |
| (b) Dispersing agent[4] | 132 |
| (c) Charge control agent[5] | 152 |
| (d) Solvent[6] | 595 |

[4]Neocryl S1004 available from Polyvinyl Corp., having a solids content of 50% in Isopar H solvent.
[5]A polymer made according to the procedure of Example XI of U.S. Pat. No. 3,900,412.
[6]Isopar H available from Exxon.

The Part 2 components were added into a 2 liter metal container. An S-1 type attritor (Union Process) containing 60 lbs. of 3/16 inch stainless steel balls was turned to its slowest speed, and the components were slowly added. The attritor cooling water was adjusted to 80° F. The mill speed was increased to 220 rpm and the milling time was 3 hours.

After milling, a small batch sample was viewed under a microscope. The majority of the particles were in the 1 to 10 micron range and they were not flocculated. An organic solvent Isopar H (564 grams) was added to the batch and mixed together for a few minutes. The mill concentrate was then removed from the attritor.

A 1% solids premix was prepared by diluting 125 grams of concentrate into 2,375 grams of Isopar G. The conductivity of the premix was measured using an Andeen-Hagerling 1KHZ ultra-precision capacitance bridge with a Balsbaugh Labs cell. The Premix charge to mass ratio (Q/M) was measured using a Fluke 412B high voltage power supply with a Keithley 610 LR electrometer and a Hunt P1-1B integrator. The Q/M cell consisted of two 4×4 inch tin oxide coated spaced a half inch apart. 1,000 volts d.c. were applied to the Plates for two minutes, and the total electric charge (in coulombs) and the weight of deposited toner were recorded. The minimum fuse temperature was measured by recording the lowest temperature that the deposited toner on the Q/M plate fused into a clear transparent coating.

The optical density of the toner was measured using a MacBeth 2020PL color eye with a 1 cm transmission cell. The toner was diluted 1 part premix into 99 parts Isopar G for this measurement. The optical density (O.D.) was recorded at nm maximum absorbance.

The premix was performance tested in a gap transfer xeroprinting device as described in U.S. Pat. No. 4,786,576, incorporated herein by reference. The photopolymer master consisted of Riston 215R (DuPont) laminated onto an aluminized polyester base. The master was exposed image-wise using 50 millijoules/CM$^2$ UV light for 30 seconds. The exposed master was installed and grounded in the xeroprinter, charged with a +6,500 volt corona, and then developed in a grounded bias toner development station. The still wet toner image was next transferred off the Photopolymer master and onto an aluminized mylar surface through a 2 mil Isopar G filled gap using a transfer Potential of +1,500 volts.

The toner of Example 1 produced extremely sharp images with 1 mil resolution, greater than 5% to 95% halftone capability with a 150 line screen, excellent image density, and good transfer off the master. No background imaging was noticed. The toned image was extremely transparent and had excellent adhesion when heat fused at >95° C. The toner is nonflocculated and redisperses upon settling. Table 1 shows the other properties.

TABLE 1

| | EXAMPLE 1 | | | |
|---|---|---|---|---|
| Example | Conductivity at 1% Solids (pico MHOS/CM) | Q/M ($10^{-6}$ Coul/g) | O.D./nm Max. | Minimum Fuse Temp. °C. |
| 1 | 5.46 | 9.62 | 0.67/620 | 95 |

EXAMPLES 2 TO 6

Four toners were prepared and tested exactly as in Example 1 except various amounts of polyethylene glycol plasticizers, shown in Table 2, were used. All of the toners produced high resolution images similar to that of Example 1. However, the toners of Examples 2 and 3 could not be heat fused into transparent images at reasonable temperatures (<120° C.) and were brittle with poor adhesion to all substrates. The toners were tested by the procedure as set forth in Example 1, and the results are shown in Table 2.

TABLE 2

EXAMPLES 2 TO 6

| Example | Grams of Plasticizer-1 | Conductivity at 1% Solids (pico MHOS/CM) | Q/M ($10^{-6}$ Coul/g) | O.D./ nm Max. | Minimum Fuse Temp.°C. |
|---|---|---|---|---|---|
| 2 | 0 | 4.87 | 9.87 | 0.68/620 | >130 |
| 3 | 40 | 4.11 | 11.29 | 0.65/620 | 130 |
| 4 | 85 | 4.79 | 9.95 | 0.69/620 | 110 |
| 5 | 125 | 5.04 | 14.79 | 0.70/620 | 105 |
| 6 | 175 | 5.21 | 13.01 | 0.68/620 | 100 |

[1]Polyethylene Glycol 600 available from Aldrich.

EXAMPLES 7 TO 12

Six toners were prepared and tested by the Procedures as set forth in Example 1, except various molecular weight polyethylene glycol (PEG) plasticizers were used. 175 grams of plasticizer were used in each example. As with Example 1, all of the toners produced high resolution images with excellent transparency and adhesion. The results are shown in Table 3.

TABLE 3

EXAMPLES 7 TO 12

| Example | MW of PEG Plasticizer | Conductivity at 1% Solids (pico MHOS/CM) | Q/M ($10^{-6}$ Coul/g) | O.D./ nm Max. | Minimum Fuse Temp.°C. |
|---|---|---|---|---|---|
| 7 | 1,000 | 5.20 | 10.15 | 0.66/620 | 100 |
| 8 | 1,500 | 5.74 | 11.33 | 0.65/620 | 100 |
| 9 | 2,000 | 4.61 | 9.77 | 0.59/620 | 100 |
| 10 | 3,400 | 4.83 | 10.10 | 0.68/620 | 100 |
| 11 | 8,000 | 4.93 | 10.18 | 0.60/620 | 95 |
| 12 | 10,000 | 5.19 | 11.66 | 0.66/620 | 95 |

EXAMPLES 13 TO 48

The toners of Examples 13 to 48 were Prepared using various pigments, described in Table 5, and having the following formula:

| Part 1 | Wt. (Grams) |
|---|---|
| (a) Colorant[1] | 100 |
| (b) Resin[2] | 810 |
| (c) Plasticizer[3] | 90 |

[1]See Table 5.
[2]Unirez 709 (Union Camp).
[3]Polyethylene Glycol 10,000 (Aldrich).

The components of Part 1 were extruded and tested as in Example 1, but they were not Fitzmilled. Instead, the large extruded pieces were broken apart with a mortar and pestle.

| Part 2 | Wt. (Grams) |
|---|---|
| (a) Part 1 above | 250 |
| (b) Dispersing Agent[4] | 132 |
| (c) Charge Control Agent[5] | 152 |

-continued

| Part 2 | Wt. (Grams) |
|---|---|
| (d) Solvent[6] | 1159 |

[4]Neocryl S-1004, available from Polyvinyl Corp.
[5]A polymer prepared according to the procedure described in Example XI of U.S. Pat. No. 3,900,412.
[6]Isopar H, available from Exxon.

The Part 2 components were added into a Kady Mill high speed disperser equipped with a cooling water jacket. The batches were milled until the largest particles measured <100 microns using a Hegeman finesse of grind gauge. Total mill times were approximately 15 minutes, and the batch temperatures were kept below 140° F.

The above Kady milled predispersions were Poured into S-1 attritors and milled for 3 hours by the procedure as in Example 1.

The completed toners were tested by the procedure as set forth in Example 1. Additionally, the continuous phase contributions to conductivity and the Q/M of only the dispersed phase were measured. The continuous phase conductivity is a measure of the Isopar soluble charge carriers which generally are not associated with the toner particles. This was determined by centrifuging the 1% solids premixes for at least 2 hours at 6,000 rpm and then measuring the conductivity of the supernatants. The percent continuous phase was calculated as follows:

$$\% \text{ In Continuous Phase} = \frac{\text{Continuous Phase conductance}}{\text{Bulk Conductance}} \times 100$$

The Q/M of the dispersed phase is a measure of the total charge on the Particles and is also related to the particle size distribution. This was determined by first making a plot of Q (from the Q/M cell) vs. conductivity (from the conductance cell). A virtually totally Isopar soluble charge director (ASA-3 available from Shell) was used for the Q versus G plot, and a Q/M electrometer showed very little change in current during the runs, indicating a very good solubility of the charge director. Table 4 shows the results:

TABLE 4

Q VERSUS CONDUCTANCE

| Concentration of A-3 in Isopar H | Q ($\times 10^{-6}$ Coul.) | Conductivity (pico MHOS/CM) |
|---|---|---|
| 6.4 ppm | 7.98 | 28.13 |
| 2.9 ppm | 3.05 | 10.66 |
| 1.4 ppm | 1.07 | 3.86 |

A standard Q/M measurement was made on each toner solids by the procedure set forth in Example 1. From the measured continuous phase conductivity and the Q vs. Conductivity plot an estimate of the Q (continuous Phase contribution) was made. The Q (dispersed phase contribution) was estimated by subtracting Q (continuous phase) from Q (Bulk). The Q/M of the dispersed phase was then measured as follows:

$$Q/M = \frac{Q\text{ (dispersed phase)} \times K}{\text{weight of toner (grams} \times 100)}$$

K = Cell correction constant = 1.3773

All of the toners in Examples 13 to 48 produced high resolution images with excellent transparency as in Example 1. The minimum fusing temperatures were all in the 95 to 100° C. range and adhesion to glass, metal, and paper was excellent.

TABLE 5

PIGMENTS USED IN EXAMPLES 13 TO 48

| Example | C.I. Pigment No. | Trade Name | Manufacturer |
|---|---|---|---|
| 13 | P.Y. 17 | Sico Fast Yellow NBK 1265 | BASF |
| 14 | P.Y. 83 | Sico Fast Yellow NBK 1765 | BASF |
| 15 | P.Y. 13 | Sico Fast Yellow NBD 1375 | BASF |
| 16 | P.Y. 12 | Sico Yellow NBD 1442 | BASF |
| 17 | P.Y. 13 | Irgalite Yellow LBIW | Ciba-Geigy |
| 18 | P.O. 34 | Irgalite Orange FZG | Ciba-Geigy |
| 19 | P.R. 57 | Lithol Rubine NBD 4663 | BASF |
| 20 | P.R. 57 | Sunsperse Rubine | Sun |
| 21 | P.R. 57 | Irgalite Rubine L4BN | Ciba-Geigy |
| 22 | P.R. 53 | Lithol Red NBD-3560 | BASF |

TABLE 5-continued

PIGMENTS USED IN EXAMPLES 13 TO 48

| Example | C.I. Pigment No. | Trade Name | Manufacturer |
|---|---|---|---|
| 23 | P.R. 53 | Sunbrite Red 5311 | Sun |
| 24 | P.R. 112 | Irgalite Red 3RS | Ciba-Geigy |
| 25 | P.R. 23 | Columbia Red 512 | Paul Uhlich |
| 26 | P.R. 81 | Rhodamine Y 6518 | Paul Uhlich |
| 27 | P.R. 81 | Fanal Pink D-4830 | BASF |
| 28 | P.R. 81 | Sunbrite Rhodamine Y | Sun |
| 29 | P.R. 81 | Rhodamine Y PTMA | Magruder |
| 30 | P.V. 1 | Rhodamine B-PMA | Magruder |
| 31 | P.V. 1 | Fanal Violet D-5480 | BASF |
| 32 | P.V. 3 | Fanal Violet D-6070 | BASF |
| 33 | P.V. 3 | Violet Toner VT8000 | Paul Uhlich |
| 34 | P.V. 23 | Permanent Violet VT2645 | Paul Uhlich |
| 35 | P.B. 15.3 | Heliogen Blue D7072 | BASF |
| 36 | P.B. 61 | Alkali Blue NBS-6157 | BASF |
| 37 | P.B. 1 | Hudson Blue BL3059 | Paul Uhlich |
| 38 | P.B. 1 | Victoria Blue SMA | Magruder |
| 39 | P.B. 2 | Peacock Blue 1095 | Paul Uhlich |
| 40 | P.B. 15:3 | Heliogen Bue D7080 | BASF |
| 41 | P.B. 15:3 | Sunfast Blue 15:3 | Sun |
| 42 | P.B. 15:3 | Irgalite Blue GLG | Ciba-Geigy |
| 43 | P.B. 15:3 | Irgalite Blue LG | Ciba-Geigy |
| 44 | P.G. 7 | Heliogen Green D-8730 | BASF |
| 45 | P.G. 7 | Sunfast Green 7 | Sun |
| 46 | P.G. 7 | Chromofine Green | Diacolor |
| 47 | P.G. 7 | Argyle Green GR0111 | Paul Uhlich |
| 48 | P.B. 7 | Mogul L | Cabot |

TABLE 6

EXAMPLE 13 TO 48

| Example | C.I. Pigment No. | Conductance at 1% Solids (pico MHOS/CM) | Continuous Phase Conductivity % | Q/M Bulk $10^{-6}$ C/g | Q/M Dispersed Phase $10^{-6}$ C/g | O.D./nm Max. | Q Bulk Coul × $10^{-6}$ | Toner Deposition (Grams) |
|---|---|---|---|---|---|---|---|---|
| 13 | P.Y. 17 BASF | 5.43 | 68 | 11.33 | 6.00 | 1.00/420 | 2.12 | 0.2459 |
| 14 | P.Y. 83 BASF | 3.57 | 56 | 8.53 | 5.96 | 0.85/460 | 1.64 | 0.2470 |
| 15 | P.Y. 13 BASF | 5.23 | 64 | 12.73 | 6.38 | 0.80/440 | 2.11 | 0.2502 |
| 16 | P.Y. 12 BASF | 5.64 | 68 | 13.22 | 6.30 | 0.90/440 | 2.23 | 0.2500 |
| 17 | P.Y. 13 CIBA-GEIGY | 4.26 | 69 | 12.60 | 6.20 | 0.81/440 | 2.00 | 0.2591 |
| 18 | P.O. 34 CIBA-GEIGY | 4.29 | 58 | 10.44 | 6.35 | 0.86/480 | 1.88 | 0.2539 |
| 19 | P.R. 57 BASF | 4.20 | 64 | 9.75 | 6.25 | 0 67/580 | 1.92 | 0.2536 |
| 20 | P.R. 57 SUN | 4.12 | 56 | 10.43 | 6.28 | 0.67/580 | 1.75 | 0.2401 |
| 21 | P.R. 57 CIBA-GEIGY | 4.47 | 69 | 10.91 | 6.22 | 0.70/580 | 1.98 | 0.2437 |
| 22 | P.R. 53 BASF | 3.95 | 62 | 8.31 | 6.01 | 0.57/540 | 1.79 | 0.2523 |
| 23 | P.R. 53 SUN | 3.54 | 60 | 8.14 | 6.00 | 0.64/540 | 1.73 | 0.2591 |
| 24 | P.R. 112 CIBA-GEIGY | 4.31 | 60 | 11.10 | 6.39 | 0.64/520 | 1.92 | 0.2474 |
| 25 | P.R. 23 PAUL UHLICH | 3.91 | 56 | 9.61 | 6.20 | 0.69/580 | 1.79 | 0.2597 |
| 26 | P.R. 81 PAUL UHLICH | 3.57 | 57 | 8.82 | 6.40 | 0.73/560 | 1.65 | 0.2315 |
| 27 | P.R. 81 BASF | 3.87 | 52 | 9.29 | 6.35 | 0.78/560 | 1.68 | 0.2408 |
| 28 | P.R. 81 SUN | 3.97 | 47 | 10.48 | 6.44 | 0.75/560 | 1.62 | 0.2333 |
| 29 | P.R. 81 MAGRUDER | 3.87 | 55 | 11.33 | 6.44 | 0.70/560 | 1.70 | 0.2343 |
| 30 | P.V. 1 MAGRUDER | 3.81 | 46 | 11.54 | 6.31 | 0.76/620 | 1.57 | 0.2339 |
| 31 | P.V. 1 BASF | 3.58 | 46 | 12.02 | 6.44 | 0.78/620 | 1.59 | 0.2403 |
| 32 | P.V. 3 BASF | 3.61 | 53 | 9.17 | 6.30 | 0.89/620 | 1.69 | 0.2520 |
| 33 | P.V. 3 PAUL UHLICH | 3.67 | 65 | 9.05 | 6.13 | 0.86/620 | 1.59 | 0.2307 |
| 34 | P.V. 23 PAUL UHLICH | 3.53 | 68 | 8.51 | 5.97 | 0.81/560 | 1.74 | 0.2436 |
| 35 | P.B. 15:3 BASF | 3.84 | 60 | 9.09 | 6.18 | 0.67/620 | 1.78 | 0.2524 |
| 36 | P.B. 61 BASF | 4.77 | 53 | 12.20 | 6.34 | 0.74/620 | 1.81 | 0.2360 |
| 37 | P.B. 1 PAUL UHLICH | 3.72 | 46 | 9.75 | 6.27 | 0.77/640 | 1.59 | 0.2414 |
| 38 | P.B. 1 MAGRUDER | 5.16 | 69 | 12.16 | 6.07 | 0.70/640 | 2.15 | 0.2592 |
| 39 | P.B. 2 PAUL UHLICH | 4.01 | 50 | 11.09 | 6.41 | 0.60/660 | 1.64 | 0.2302 |
| 40 | P.B. 15:3 BASF | 3.88 | 58 | 9.72 | 6.11 | 0.84/620 | 1.66 | 0.2309 |
| 41 | P.B. 15:3 SUN | 3.57 | 67 | 8.70 | 6.03 | 1.12/620 | 1.74 | 0.2421 |
| 42 | P.B. 15:3 CIBA-GEIGY | 3.79 | 62 | 10.69 | 6.15 | 0.76/620 | 1.80 | 0.2531 |
| 43 | P.B. 15:3 CIBA-GEIGY | 3.65 | 68 | 9.98 | 6.03 | 0.67/620 | 1.74 | 0.2346 |
| 44 | P.G. 7 BASF | 4.14 | 57 | 10.53 | 6.07 | 0.70/420 | 1.76 | 0.2475 |
| 45 | P.G. 7 SUN | 3.79 | 47 | 8.81 | 6.13 | 0.69/420 | 1.67 | 0.2598 |
| 46 | P.G. 7 DIACOLOR | 5.58 | 68 | 13.00 | 6.10 | 0.74/420 | 3.67 | 0.2360 |
| 47 | P.G. 7 PAUL UHLICH | 5.60 | 70 | 13.00 | 6.17 | 0.70/420 | 2.23 | 0.2494 |
| 48 | P.B. 7 CABOT | 4.74 | 68 | 12.95 | 6.24 | 0.83/580 | 1.97 | 0.2325 |

EXAMPLE 49

A toner was prepared and tested exactly by the Procedure for the toners of Examples 13 to 48, except the Part 2 mill concentrate was made at 40% solids instead of 20% solids as follows:

| | Wt. (grams) |
|---|---|
| Part 1[1] | 354.2 |
| Dispersant[2] | 187.0 |
| Charge Agent[2] | 215.3 |
| Solvent[2] | 443.4 |

[1]Same as in Example 35 (pigment is Heliogen Blue D7072).
[2]Same as in Examples 13 to 48.

The toner concentrate flowed freely at 40% solids and had a viscosity in the 300 cps range. The 40% solids concentrate was placed in a Savin 5030 copier toner replenishment bottle equipped with a valve and allowed to sit one month undisturbed with the valve side down. After one month, the toner concentrate still flowed easily and did not clog the valve. The toner could easily be diluted directly from a 40% concentrate into an approximately 1% solids developer premix bath with no noticeable flocculation or agglomeration.

The imaging properties of the toner of Example 49 are virtually identical to those of the toners of Examples 13 to 48. Table 6 shows the other properties:

TABLE 7

EXAMPLE 49

| Conductivity at 1% Solids (pico MHOS/CM) | Continuous Phase Conductance | Q/M Bulk ($10^{-6}$ C/g) | Q/M Dispersed Phase $10^{-6}$ Coul/g) | Q Bulk (Coul × $10^{-6}$) | Toner Q/M Deposition (grams) | O.D./nm |
|---|---|---|---|---|---|---|
| 3.86 | 57% | 10.65 | 6.06 | 1.68 | 0.2396 | 0.80/620 |

EXAMPLE 50

To demonstrate toner color blending ability, 1,250 g of the Pigment of Example 17 was blended with 1,250 g of the Pigment of Example 35 to produce a green shade toner blend. Each toner and the blend were in a diluted (1% solids) working bath premix form. The blended toner was next added to a Savin 5030 liquid toner copier and 700 copies of an 8% coverage test pattern were made with no replenishment of the toner bath. This depleted about 80% of the toner solids in the premix. The depletion caused a continuous drop in image densities throughout the run making it very difficult to colorimetrically compare the first print with a "depleted toner" print and relate this to hue differences. To get around this, the toner bath had to be monitored off-line. Specifically, at 100 copy intervals, the toner was transferred into a plating cell normally used for Q/M testing. Paper was taped over the anode and toner was Plated directly onto the paper. The toned paper was next dried and fused with a heat gun. To give constant image densities, plating time was increased according to bath depletion. The toner bath absorbance was also monitored at 100 copy intervals at 420 nm and 0.01 dilution in Isopar H. Before the print test, a plot of blended toner bath absorbance vs. plating time was made at an approximately constant 1.20 image density.

After the print test, each plated color "swatch" was measured in CIE L*a*b* color space using a MacBeth 2020PL color-eye. To monitor only the hue differences, L (lightness) values were kept within ±0.1 for each data point. The total color difference (dE) was recorded for each data Point as compared with the start. Total color difference is defined as:

$$dE = \sqrt{(\Delta L)^2 + (\Delta a)^2 + (\Delta b)^2}$$

A dE≦| is generally not perceived as a color difference by most people. Table 8 shows that the dE was less than one throughout the 700 copy run which indicates that both of the blended toners depleted virtually at the same rate. Visually, no significant color difference was noticed in any of the color swatches. This example also demonstrates the feasibility of using these toners with a contact transfer process, e.g , Savin copier.

TABLE 8

EXAMPLE 50

| Copy No. | Developer Absorbance* | Plating Time (sec.) | L* | a* | b* | dE |
|---|---|---|---|---|---|---|
| Start | 0.61 | 15 | 50.77 | −45.12 | 17.94 | |
| 100 | 0.50 | 25 | 50.73 | −45.50 | 17.83 | 0.36 |
| 200 | 0.40 | 38 | 50.72 | −45.28 | 18.02 | 0.19 |
| 300 | 0.31 | 50 | 50.79 | −45.07 | 17.52 | 0.42 |
| 400 | 0.27 | 56 | 50.79 | −45.14 | 17.57 | 0.37 |
| 500 | 0.22 | 61 | 50.78 | −44.73 | 17.50 | 0.59 |
| 600 | 0.18 | 65 | 50.71 | −44.43 | 17.43 | 0.86 |
| 700 | 0.13 | 72 | 50.79 | −44.42 | 17.26 | 0.98 |

*0.01 dilution in Isopar H.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All Patent applications, patents, and other publications cited herein are incorporated by reference in their entirety.

What is claimed is:

1. A method of fabricating a toned pattern on an electrically isolated nonabsorbent conductive receiving surface, comprising the steps of:

(a) establishing a charged electrostatic latent image area on an electrostatically imageable surface;

(b) developing the electrostatic latent image area by applying to the electrostatically imageable surface charged toner particles of a predetermined height suspended in a liquid comprised at least partially of a nonpolar insulating solvent to form a first liquid layer with a first liquid surface, the charged toner particles being directed to the latent image area of the electrostatically imageable surface to form a developed latent image;

(c) applying to the conductive receiving surface a liquid comprised at least partially of a nonpolar insulating solvent to form a second liquid layer with a second liquid surface;

(d) establishing an electric field between the electrostatically imageable surface and the conductive receiving surface by connecting a D.C. voltage directly to the conductive receiving surface;

(e) placing the conductive receiving surface adjacent to the electrostatically imageable surface so that a gap is maintained therebetween, and the first liquid surface contacts the second liquid surface to create a liquid transfer medium across the liquid-filled gap, the liquid-filled gap being of a depth greater than the height of the toner particles.

(f) transferring the developed latent image from the electrostatically imageable surface at a point of transfer through the liquid to the conductive receiving surface to form a transferred toner particle image in an imaged area and defined nonimaged area where toner particles are absent;

(g) maintaining the gap during transfer to the developed latent image between the electrostatically imageable surface and the conductive receiving surface at the point of transfer between at least about 1 mil and about 20 mils; and (h) fusing the transferred toner particles image to the conductive receiving surface;

said toner being a liquid color toner composition comprising:

(a) an organic solvent;

(b) a fine particle size compounded mixture comprising:

(i) a resin matrix which is essentially insoluble and nonswellable in said solvent, (ii) submicron-size pigment particles dispersed with the resin, and (iii) a plasticizer which is compatible with the resin, said compounded mixture being essentially insoluble and nonswellable in said solvent, and (c) a dispersing agent capable of dispersing the particles in the compounded mixture; and optionally (d) a charge control agent which will render the toner either positive or negative.

2. A method as defined in claim 1 which includes the following steps:

(a) etching the nonimaged areas of the conductive receiving surface to remove the conductive receiving surface from the nonimaged areas of the conductive receiving surface on the conductor laminate; and (b) removing the toner particles from the imaged area.

3. A method of fabricating a toned pattern on an electrostatically imageable surface, comprising the steps of:

(a) establishing a charged electrostatic latent image area on an electrostatically imageable surface;

(b) developing the electrostatic latent image area by applying to the electrostatically imageable surface charged toner particles of a predetermined height suspended in a liquid comprised at least Partially of a nonpolar insulating solvent to form a first liquid layer with a first liquid surface, the charged toner particles being directed to the latent image area of the electrostatically imageable surface to form a developed latent image;

(c) fusing the transferred toner particles image to the electrostatically imageable surface;

said toner being a liquid color toner composition comprising:

(a) an organic solvent;

(b) a fine particle size compounded mixture comprising:

(i) a resin matrix which is essentially insoluble and nonswellable in said solvent, (ii) submicron-size pigment Particles dispersed with the resin, and (iii) a Plasticizer which is compatible with the resin, said compounded mixture being essentially insoluble and nonswellable in said solvent, and (c) a dispersing agent capable of dispersing the particles in the compounded mixture; and optionally (d) a charge control agent which will render the toner either positive or negative.

* * * * *